United States Patent [19]

Franklin

[11] 4,381,649

[45] May 3, 1983

[54] $CO_2$ SNOW PRODUCER WITH HEAT EXCHANGER

[76] Inventor: Paul R. Franklin, P.O. Box 37978, Jacksonville, Fla. 32205

[21] Appl. No.: 355,865

[22] Filed: Mar. 8, 1982

[51] Int. Cl.[3] ..... F17C 3/00

[52] U.S. Cl. ..... 62/47; 62/388; 62/514 R

[58] Field of Search ..... 62/10, 12, 35, 76, 330, 62/384, 388, 514 R, 47

[56] References Cited

U.S. PATENT DOCUMENTS

| | | | |
|---|---|---|---|
| 2,247,850 | 7/1941 | Rayburn | 62/121 |
| 2,483,064 | 9/1949 | Reich | 62/388 |
| 2,731,807 | 1/1956 | Allyne | 62/388 |
| 2,791,888 | 5/1957 | Vani | 62/384 |
| 3,561,226 | 2/1971 | Rubin | 62/388 |
| 3,695,056 | 10/1972 | Glynn et al. | 62/384 |
| 3,815,377 | 6/1974 | Tyree, Jr. | 62/384 |

*Primary Examiner*—Ronald C. Capossela
*Attorney, Agent, or Firm*—Harvey B. Jacobson

[57] ABSTRACT

A method and apparatus is disclosed whereby liquid refrigerant, such as liquefied carbon dioxide, is discharged from the outlet end portion of a supply line whose inlet end portion is communicated with a source of liquefied carbon dioxide under pressure and wherein the discharge of liquefied carbon dioxide from the outlet end portion of the line is effected through a spray head directed toward surface portions upon which the spray discharge of liquefied carbon dioxide may impinge for conversion to carbon dioxide snow and carbon dioxide gas and further wherein an intermediate portion of the supply line is disposed in good heat transfer relation with the aforementioned surface portions for cooling the intermediate portion of the supply line to a temperature closely approaching the triple point temperature (approximately minus 69° F.) with the pressure of the liquefied carbon dioxide being discharged from the spray head being approximately 75 psi absolute. The rate of flow of the liquefied carbon dioxide into the inlet end of the line is regulated according to the flow of liquefied carbon dioxide through the spray head in a manner such that the pressure of the liquefied carbon dioxide at the spray head is maintained at approximately 75 psi absolute.

9 Claims, 3 Drawing Figures

FIG. 1
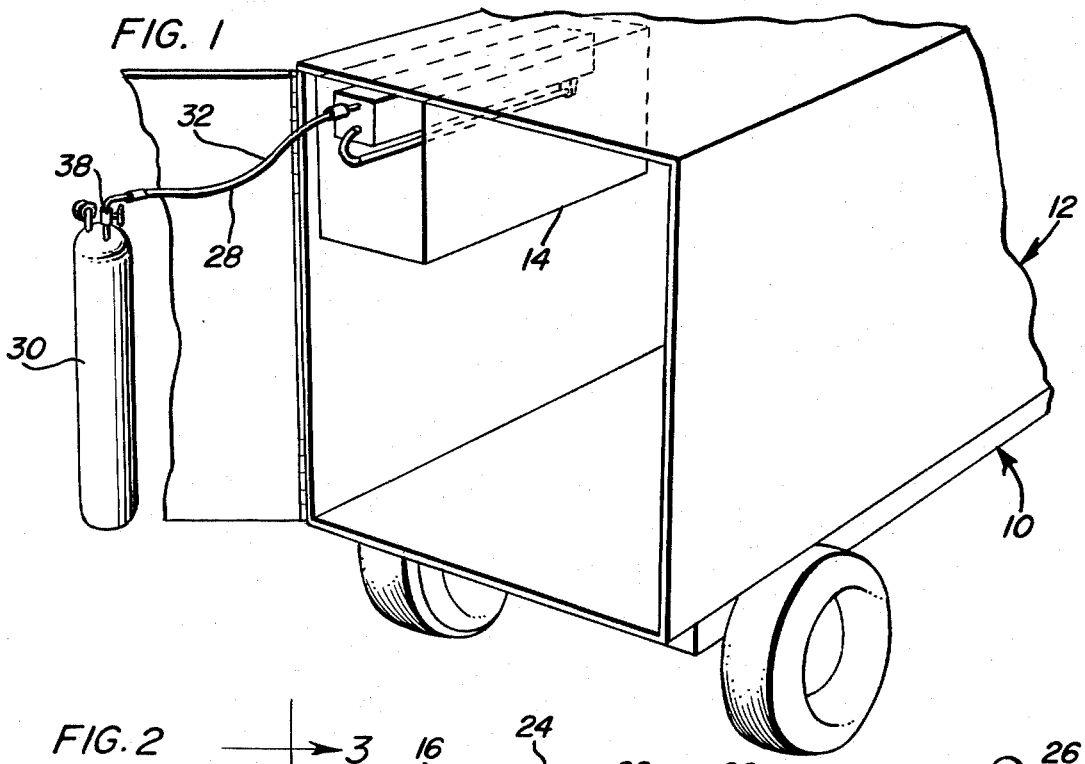
FIG. 2
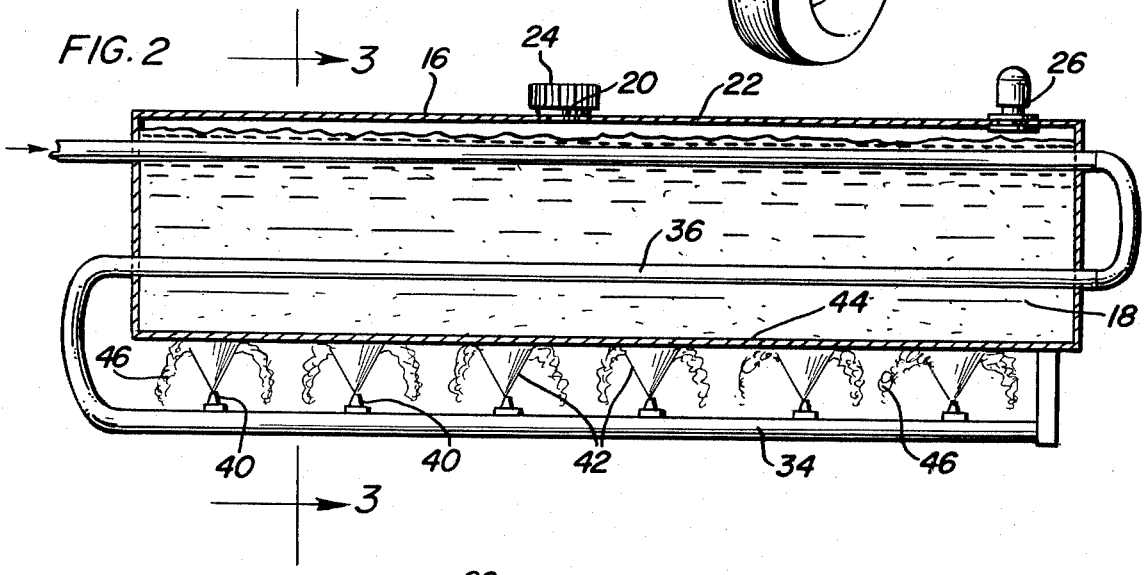
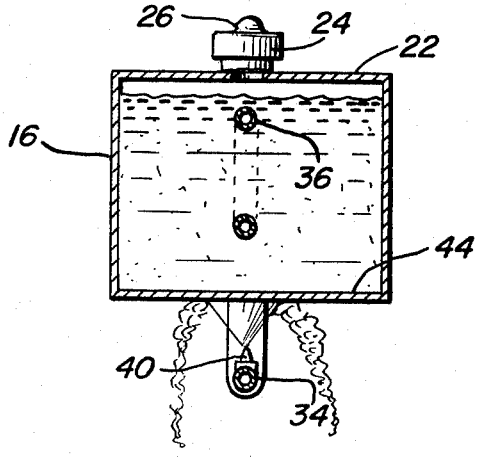
FIG. 3

$CO_2$ SNOW PRODUCER WITH HEAT EXCHANGER

BACKGROUND OF THE INVENTION

Liquid nitrogen and liquid $CO_2$ are conventionally utilized to cool the interiors of insulated containers as well as materials stored therein for the purpose of maintaining low temperatures of the materials and the interior of the insulated containers, especially when the containers are to be used in shipment of the materials therein over extended periods of time without benefit of mechanical or absorption type refrigeration systems. In addition, insulated containers are also conventionally provided with cold holdover plates which may be refrigerated by suitable mechanical or absorption type refrigeration equipment at a starting point and thereafter disconnected from the refrigeration equipment and utilized to maintain the interior of a container in which they are disposed as well as other contents of the container refrigerated over extended periods of time.

The utilization of liquefied nitrogen and carbon dioxide as well as cold holdover plates is presently enjoying increased popularity, inasmuch as transit type containers refrigerated by mechanical or absorption type refrigeration systems often experience malfunction of the attendant refrigeration units and the contents of the refrigerated container is subject to spoilage.

The utilization of liquefied nitrogen for refrigerating the interiors of shipping containers is usually employed when very low freezing temperatures are desired within the container and cold holdover plates are usually used for refrigerating containers when cooling or mild freezing temperatures within the container are required. The use of liquefied carbon dioxide for refrigerating shipping containers is generally limited to containers in which cooling or moderately low freezing temperatures are required and the liquefied carbon dioxide is, in most cases, utilized to form carbon dioxide snow which is approximately minus 69° F., at the triple point pressure of 75 lbs. per square inch absolute, but which drops from minus 69° F. to minus 109° F. at atmospheric pressure. Further, $CO_2$ snow is conventionally formed by discharging chilled liquid carbon dioxide from spray nozzles. In such instance, the liquid carbon dioxide is supplied to the spray nozzles at approximately 0° F. with the result that one lb. of liquid carbon dioxide will yield approximately 0.40 to 0.45 lbs. of carbon dioxide snow. However, if the temperature and pressure of the liquid carbon dioxide can be maintained at the triple point wherein the pressure thereof is approximately 75 lbs. per square inch absolute and the temperature is approximately minus 69° F., one pound of liquid carbon dioxide will yield approximately 0.46 to 0.51 lbs. of carbon dioxide snow.

There are three distinct thermal cycles which may be used in the manufacture of solid carbon dioxide (carbon dioxide snow). These distinct thermal cycles include the non-regenerative, the regenerative and the complete re-expansion cycles. However, each of these cycles requires considerable machinery and are thus not practiced to any great extent in the production of carbon dioxide snow to be used in insulated transport containers.

Accordingly, a need exists for an improved, simple and efficient method of producing a maximum amount of carbon dioxide snow from a given amount of liquid carbon dioxide.

Examples of carbon dioxide snow producing machines including some of the general structural and operational features of the instant invention are disclosed in U.S. Pat. Nos. 2,247,850, 2,483,064, 2,731,807, 3,561,226, 3,695,056 and 3,815,377.

SUMMARY OF THE INVENTION

An intermediate portion of a liquid carbon dioxide supply line equipped with spray jet discharge structure on the outlet end thereof is passed through the interior of a tank containing an eutectic solution and the spray jet discharge structure is positioned to direct spray jets of liquid carbon dioxide onto the exterior of the eutectic solution tank for cooling the tank structure and the eutectic solution therein with the latter thereby cooling the intermediate portion of the liquid carbon dioxide supply line passing through the eutectic solution. The pressure of the liquid carbon dioxide within the discharge end of the supply line is maintained at approximately 75 psi absolute and the volume and type of the eutectic solution used, the thermal conductivity of the tank and the eutectic solution and the length of the intermediate portion of the liquid carbon dioxide gas supply line extending through the eutectic solution is predetermined such that the rate of flow of liquid carbon dioxide through the supply line will result in the temperature of the liquid carbon dioxide in the outlet end of the supply line being reduced to approximately minus 69° F. In this manner, the weight of carbon dioxide snow produced by the spray head structure will be equal to approximately 50% of the weight of the liquid carbon dioxide consumed in the production of the carbon dioxide snow. Further, the eutectic solution tank utilized in this process is disposed within the insulated contained to be ultimately maintained cooled by the carbon dioxide snow produced and collected therein. In this manner, substantially all of the latent heat of fusion is transformed into heat absorbing capacity within the insulated container to be maintained cooled.

The main object of this invention is to provide an improved method of more efficiently producing carbon dioxide snow for cooling the interiors of insulated containers.

Another object of this invention is to provide a method and apparatus in accordance with the immediately preceding object and wherein the structure required to carry out the method is maintained extremely simple and thus quite inexpensive.

A still further object of this invention is to provide a method and apparatus for converting liquid carbon dioxide to carbon dioxide snow wherein the production of the desired amount of carbon dioxide snow may be accomplished at a rapid rate.

A final object of this invention to be specifically enumerated herein is to provide a method and apparatus in accordance with the preceding objects and which will conform to conventional forms of manufacture, be of simple construction and easy to use so as to provide a method and apparatus which will be economically feasible and extremely dependable.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view illustrating the rear of an insulated container comprising a truck load body and with the structure of the instant invention operatively mounted within the container;

FIG. 2 is an enlarged vertical sectional view of the carbon dioxide snow producing structure of the instant invention; and FIG. 3 is a sectional view taken substantially upon the plane indicated by the section line 3—3 of FIG. 2.

DETAILED DESCRIPTION OF THE INVENTION

Referring now more specifically to the drawings, the numeral 10 generally designates a truck-type vehicle including a load box referred to in general by the reference numeral 12 and comprising an insulated container such as that conventionally used on truck chassis for transport of chilled or frozen materials over extended periods of time.

Conventionally, the container 12 may be provided with liquid nitrogen jet discharge structure for chilling the interior thereof, cooled holdover plates which may be mechanically refrigerated at a shipping starting point or chilling cabinets or containers having carbon dioxide snow therein.

The utilization of jets of liquid nitrogen within the container 12 after its closure requires venting of the container before workmen may enter therein at each stop, cold holdover plates are quite heavy and expensive and the use of carbon dioxide snow filled chilling cabinets has in the past resulted in excessive use of liquid carbon dioxide in order to form the desired amounts of carbon dioxide snow.

The instant invention utilizes a cabinet or container 14 mounted within the load body or container 12 and with the lower portion of the container 14 defining an upwarly opening receptacle in which to receive gravity falling carbon dioxide snow. The upper portion of the interior of the container 14 contains a tank 16 of eutectic solution 18, such as Freon 11, or a propylene glycol. The tank 16 includes a fill neck 20 opening downwardly through its top wall 22 removably closeable by a removable cap 24 and the top wall 22 also includes an excess pressure relief valve 26 opening therethrough.

A supply line 28 extends from a suitable source 30 of chilled (0° F.) liquid carbon dioxide and includes an inlet end portion 32 extending from the source 30 toward the tank 16, an outlet end portion 34 supported beneath the tank 16 and an intermediate portion 36 which passes through the tank 16 and the eutectic solution 18 disposed therein. The supply line 28 includes a pressure regulator 38 for maintaining the pressure within the supply line 28 at a predetermined adjusted pressure and the outlet end portion 34 of the supply line 28 includes upwardly opening spray jet heads 40 spaced therealong positioned to direct upward spray jets 42 of liquid carbon dioxide onto the undersurface of the bottom wall 44 of the tank 16.

In operation, liquid carbon dioxide is allowed to flow through the supply line 28 at a pressure of to approximately 75 lbs. per square inch absolute and to be discharged from the spray jet heads 40 at that pressure onto the undersurface of the bottom wall 44 of the tank 16. The discharge of the spray jets 42 onto the bottom wall 44 of the tank 16 will not only cause an initial amount of carbon dioxide snow 46 to be formed and to fall by gravity downwardly into the receptacle defining upwardly opening lower portion of the cabinet or container 14, but the bottom wall 44 of the tank 16 will be cooled to a temperature considerably lower than minus 70° F. As a result of the bottom wall 44 being cooled, the eutectic solution 18 will be cooled and the intermediate portion 36 of the supply line 28 will also be cooled. The rate of flow of liquid carbon dioxide through the supply line 28 is controlled by the valve 38 such that the cooling action of the eutectic solution 18 on the intermediate portion 36 of the supply line 28 will lower the temperature of the liquid carbon dioxide flowing through the intermediate portion 36 to a temperature approaching minus 69° F. Accordingly, inasmuch as the triple point pressure of 75 lbs. per square inch absolute and the corresponding temperature approaching minus 69° F. is maintained, the liquid carbon dioxide being discharged from the spray jet heads 40 in the form of the spray jets 42 will be transformed substantially directly into carbon dioxide snow with little loss as carbon dioxide gas. It has been found that if the above triple point temperature and pressure are substantially realized, the weight of carbon dioxide snow produced will be approximately 50% of the weight of the liquid carbon dioxide used to produce the carbon dioxide snow. Accordingly, considerable additional production of carbon dioxide snow is realized than is generally accomplished by merely discharging liquid carbon dioxide through snow producing heads substantially independent of temperature and pressure controls of the liquid carbon dioxide being discharged through the spray heads. In addition, inasmuch as the cabinet or container 14 itself is enclosed within the insulated load box or container 12, the additional heat absorbing capacity of the liquid carbon dioxide utilized to refrigerate the tank 16 and the eutectic solution 18 therein is retained and suitable blowers or other structures capable of circulating the air within the container 12 through and about the container 14 during transit of the container 12 may be utilized and controlled by thermostatic control in order to provide the necessary cooling of the interior of the container 12.

It is to be appreciated that while the weight of carbon dioxide snow produced is only 50% of the weight of the liquid carbon dioxide used to produce the carbon dioxide snow, the cooling capacity of the carbon dioxide snow produced is augmented by the cooling capacity of the chilled tank 16 and the eutectic solution 18 therein to the extent that the over-all cooling capacity of the carbon dioxide snow produced and the chilled eutectic solution resonably closely approaches the latent heat of sublimation, not including the heat of superheat at 0° F. which is approximately 20 B.t.u. per pound.

Although the structure and method of the instant invention has been specifically disclosed hereinabove utilizing liquid carbon dioxide, it is to be noted that the invention may also incorporate the utilization of a suitable liquid refrigerant other than liquid carbon dioxide.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A refrigerant snow producer including a refrigerant supply line having a first end communicated with a source of liquid refrigerant under pressure, a second end of said supply line including a plurality of spray jet outlet means opening outwardly therefrom, a heat exchange structure of high heat exchange capacity, said plurality of spray jet outlet means being arranged closely spaced from and to spray spaced jets of liquid refrigerant onto heat exchange surfaces of said heat exchanger structure, an intermediate portion of said supply line being in good heat exchange relation with said heat exchange structure, whereby the absorption of heat from said heat exchanger by the spraying of jets of liquid refrigerant thereon will in turn absorb heat from said intermediate portion of said line and reduce the temperature of the refrigerant flowing therethrough to a temperature at least near the temperature of the triple point of said refrigerant thereby enabling almost complete transformation of the liquid refrigerant being discharged from said spray jet outlet means directly into refrigerant snow and with minimal portions of the jet discharged liquid refrigerant being transformed into refrigerant gas.

2. The snow producer of claim 1 wherein said heat exchange structure, intermediate supply line portion and second supply line end portion are disposed within a container whose interior is to be maintained chilled, an upwardly opening refrigerant snow receiving receptacle means disposed beneath said heat exchange surface of said heat exchange structure for receiving refrigerant snow falling by gravity from said heat exchange surfaces, said receptacle comprising a heat exchanger.

3. The snow producer of claim 2 wherein said receptacle means includes the lower portion of a housing in which said heat exchange structure is disposed.

4. The snow producer of claim 3 wherein said housing is disposed within said container.

5. The snow producer of claim 4 wherein said second end of said line includes at least a minimum length portion thereof intermediate said spray jet outlet means and said intermediate portion disposed exteriorly of said receptacle means.

6. A carbon dioxide snow producer including a liquid carbon dioxide supply line having a first end communicated with a source of liquid carbon dioxide under pressure, a second end of said line including a plurality of spaced spray jet outlet means, a heat exchange structure of high heat exchange capacity, said plurality of spray jet outlet means being arranged closely spaced from and to spray spaced jets of liquid carbon dioxide onto heat exchange surfaces of said heat exchange structure, an intermediate portion of said supply line being in good heat exchange relation with said heat exchange structure, whereby the absorption of heat from said heat exchanger by the spraying of jets of liquid carbon dioxide thereon will in turn absorb heat from said intermediate portion of said line and reduce the temperature of the liquid carbon dioxide flowing therethrough to a temperature at least near the triple point temperature of liquid carbon dioxide thereby enabling almost complete transformation of the liquid carbon dioxide being discharged from said spray jet outlet means directly into carbon dioxide snow and with minimal portions of the jet discharged liquid carbon dioxide being transformed into carbon dioxide gas.

7. The method of substantially maximum efficiency use of liquid phase changeable refrigerant of the type expandable from liquid into a gas and, when at the triple point temperature and pressure, expandable from a liquid state directly to a solid state, said method comprising passing liquid refrigerant through a supply line from an inlet end of the line toward the opposite outlet end thereof, passing an intermediate length portion of said line in good heat transfer relation with heat transfer means, and discharging liquid refrigerant from said outlet end of said line through spray nozzle means operative to direct spray jets of said liquid refrigerant against said heat transfer means for simultaneously cooling the latter and transforming said spray jets of liquid refrigerant substantially completely directly into refrigerant snow with the cooled heat transfer means serving to cool the liquid refrigerant passing through said intermediate length portion of said line to a temperature closely approaching the triple point temperature of said liquid refrigerant, said method further including the passage of said liquid refrigerant through said line at a pressure generally equal to the triple point pressure of said liquid refrigerant.

8. The method of maximally utilizing the production of refrigerant snow as described by the method of claim 7 for the purpose of cooling the interior of a refrigerated load container wherein the heat transfer means of is disposed within said container and a heat exchange type receptacle is provided within said container for gravity receiving the refrigerant snow produced.

9. The method of claim 8 wherein the liquid phase changeable refrigerant comprises liquid carbon dioxide.

* * * * *